US012110649B2

(12) United States Patent
Hughes

(10) Patent No.: US 12,110,649 B2
(45) Date of Patent: Oct. 8, 2024

(54) COUPLER

(71) Applicant: HUGHES ASSET GROUP PTY LTD., Bayswater (AU)

(72) Inventor: Noel Robert Hughes, Bayswater (AU)

(73) Assignee: HUGHES ASSET GROUP PTY LTD., Bayswater (AU)

( * ) Notice: Subject to any disclaimer, the term of this patent is extended or adjusted under 35 U.S.C. 154(b) by 550 days.

(21) Appl. No.: 17/298,192

(22) PCT Filed: Nov. 27, 2019

(86) PCT No.: PCT/AU2019/051300
§ 371 (c)(1),
(2) Date: May 28, 2021

(87) PCT Pub. No.: WO2020/107069
PCT Pub. Date: Jun. 4, 2020

(65) Prior Publication Data

US 2022/0098821 A1 Mar. 31, 2022

(30) Foreign Application Priority Data

Nov. 30, 2018 (NZ) ..... 748887

(51) Int. Cl.
*E02F 3/36* (2006.01)

(52) U.S. Cl.
CPC ..... *E02F 3/3618* (2013.01); *E02F 3/3622* (2013.01); *E02F 3/365* (2013.01); *E02F 3/3663* (2013.01)

(58) Field of Classification Search
CPC ..... E02F 3/3604; E02F 3/3609; E02F 3/3618; E02F 3/3622; E02F 3/3627; E02F 3/3631; E02F 3/365; E02F 3/3663
See application file for complete search history.

(56) References Cited

U.S. PATENT DOCUMENTS 6,233,852 B1 * 5/2001 Pemberton ..... E02F 3/3668 37/468
6,964,122 B2 * 11/2005 Cunningham ..... E02F 9/2292 37/468

(Continued)

FOREIGN PATENT DOCUMENTS

AU 2016225818 A1 9/2016
CA 2577732 A1 8/2008

(Continued)

OTHER PUBLICATIONS

International Written Opinion for International Application No. PCT/AU2019/051300 mailed Jan. 23, 2020 (7 pages).

(Continued)

*Primary Examiner* — Jonathan P Masinick
(74) *Attorney, Agent, or Firm* — Merchant & Gould P.C.

(57) ABSTRACT

A coupler for coupling an implement having first and second spaced apart parallel pins, to the arm of a vehicle. The coupler has a body for attaching to the vehicle arm, a first fixed jaw, a movable second jaw facing away from the first jaw, and an actuator to selectively move the second jaw towards and away from the first jaw. The first jaw includes a lip forward of the seat for the first pin. A first locking member is pivotable between a locking position, in which a portion of the locking member protrudes into the opening of the first jaw, and an unlocked position. A second locking member is pivotable between a locking position in which a portion of the second locking member constricts the opening of the second jaw, and an unlocked position. Movement of the second jaw causes movement of the first locking member.

22 Claims, 10 Drawing Sheets

(56) References Cited

U.S. PATENT DOCUMENTS

| | | | | |
|---|---|---|---|---|
| 7,306,395 | B2 * | 12/2007 | Fatemi | E02F 3/365 403/321 |
| 7,648,305 | B2 * | 1/2010 | Beales | E02F 3/3618 37/468 |
| 8,151,494 | B2 * | 4/2012 | Scheib | E02F 3/3618 37/468 |
| 8,556,534 | B2 * | 10/2013 | Lim | E02F 3/3663 37/468 |
| 8,678,697 | B2 * | 3/2014 | Monaghan | E02F 3/3663 37/468 |
| 8,684,623 | B2 * | 4/2014 | Robl | E02F 3/364 37/468 |
| 8,782,931 | B2 * | 7/2014 | Balemi | A01B 59/06 37/468 |
| 9,206,582 | B2 * | 12/2015 | Doherty | E02F 3/3622 |
| 9,670,642 | B2 * | 6/2017 | Pesch | E02F 3/3618 |
| 9,863,117 | B2 * | 1/2018 | Calvert | E02F 3/3627 |
| 10,066,359 | B2 * | 9/2018 | De Courcey | E02F 3/3622 |
| 10,184,224 | B2 * | 1/2019 | Ito | E02F 3/3663 |
| 10,400,419 | B2 * | 9/2019 | Hart | E02F 3/3663 |
| 10,669,690 | B2 * | 6/2020 | Doherty | E02F 3/3654 |
| 2001/0050326 | A1 * | 12/2001 | Muroto | E02F 3/3613 248/226.11 |
| 2010/0247228 | A1 | 9/2010 | Monaghan et al. | |
| 2013/0164080 | A1 * | 6/2013 | Miller | E02F 3/3604 403/373 |
| 2014/0294497 | A1 * | 10/2014 | Robl | E02F 3/365 403/376 |
| 2014/0301779 | A1 | 10/2014 | Balemi | |
| 2014/0308061 | A1 * | 10/2014 | Robl | E02F 9/26 73/849 |
| 2015/0259874 | A1 * | 9/2015 | Cunningham | E02F 3/3672 74/89.39 |
| 2015/0322646 | A1 * | 11/2015 | Anderson | E02F 3/3622 403/322.1 |
| 2015/0330053 | A1 * | 11/2015 | Ravindran | E02F 3/3618 403/91 |
| 2016/0237656 | A1 * | 8/2016 | Doherty | E02F 3/3618 |

FOREIGN PATENT DOCUMENTS

| | | | |
|---|---|---|---|
| CN | 102782220 | A | 11/2012 |
| EP | 3211143 | A1 | 8/2017 |
| EP | 2215309 | B1 | 1/2019 |
| GB | 2447809 | A | 9/2008 |
| KR | 101651856 | B1 | 9/2016 |
| WO | 2018/074937 | A1 | 4/2018 |
| WO | 2020/002882 | A2 | 1/2020 |

OTHER PUBLICATIONS

International Search for International Application No. PCT/AU2019/051300 mailed Jan. 23, 2020 (5 pages).

* cited by examiner

COUPLER

This application is a National Stage Application of PCT/AU2019/051300, filed 27 Nov. 2019, which claims benefit of Serial No. 748887, filed 30 Nov. 2018 in New Zealand and which applications are incorporated herein by reference. To the extent appropriate, a claim of priority is made to each of the above disclosed applications.

FIELD OF THE INVENTION

The present disclosure relates to a coupler for coupling an implement to the arm of an excavator, digger, or other earth moving machine or vehicle. In particular, the coupler is a hydraulic coupler with a safety mechanism to prevent decoupling in the event of a hydraulic failure.

BACKGROUND

Couplers, also commonly called "hitches", are used to removably connect implements such as an excavation bucket or other earth moving implement, to an arm of a machine such as an excavator, digger, or back hoe. These couplers are typically mounted to the free end of the arm and configured to engage a pair of parallel pins ordinarily provided on earth moving implements for connection of the implement to the arm.

Modern couplers are operated using a hydraulic actuator. This enables implements to be changed out from the arm quickly and remotely by the vehicle operator, releasing one implement from the coupler, and engaging the pins of another implement. During use, implements are held securely by the coupler under hydraulic pressure. However, in the event of a failure resulting a loss of hydraulic pressure, there is a risk of the implement coming loose or falling from the arm. A loose or dropped implement is a safety hazard and can result in serious injury.

To mitigate this risk, hydraulic couplers commonly have one or more safety lock features to ensure one or both of the pins on the implement remain engaged with the coupler in the case of a hydraulic or other failure. A safety lock that only locks one of the pins is less desirable than one that locks both pins, as the implement can still cause injury by partly falling from the coupler and swinging around the locked pin.

Existing safety lock systems that lock both pins to the coupler face challenges relating to reliability. The couplers and their lock systems are usually used in harsh environments and exposed to dirt, sand, cement, and/or grit. These debris particles can cause the lock system to become inoperable, for example. by compromising locking performance, causing jamming and inhibiting removal of the implement from the coupler, and/or increasing forces and wear of components. The couplers and safety mechanism also must be sufficiently robust to withstand large loads commonly experienced in excavation equipment.

It is an object of at least preferred embodiments of the present invention to address one or more of the above mentioned shortcomings and/or to at least provide the public with a useful alternative.

In this specification where reference has been made to patent specifications, other external documents, or other sources of information, this is generally to provide a context for discussing features of the invention. Unless specifically stated otherwise, reference to such external documents or sources of information is not to be construed as an admission that such documents or such sources of information, in any jurisdiction, are prior art or form part of the common general knowledge in the art.

SUMMARY OF THE INVENTION

In a first aspect the invention broadly consists in a coupler for coupling an implement having first and second spaced apart parallel pins, to the arm of a vehicle or machine. The coupler comprises a body for attaching to the vehicle or machine arm; a first jaw fixed relative to the body, defining an opening and a seat for receiving the first implement pin; a movable second jaw, defining an opening and a seat for receiving the second implement pin, the first and second jaws facing away from each other; an actuator operable to selectively move the second jaw towards and away from the first jaw along a movement axis, between an extended position with the second jaw distal to the first jaw and a contracted position with the second jaw proximal the first jaw; a first locking member that is pivotable relative to the first jaw between a locking position, in which a portion of the locking member protrudes into the opening of the first jaw, and an unlocked position, in which the locking member is substantially or wholly retracted from the opening of the first jaw, and a second locking member that is pivotable relative to the second jaw between a locking position in which a portion of the second locking member constricts the opening of the second jaw, and an unlocked position, in which the second locking member is substantially or wholly retracted from the opening of the second jaw. Movement of the second jaw from the extended position towards the contracted position causes movement of the first locking member from the unlocked position towards the locked position. The first jaw includes a lip forward of the seat for the first pin, the lip protruding in a direction generally towards the first locking member.

In an embodiment, the lip of the first jaw is shaped such that, in a vertical orientation of the coupler with the second jaw above the first jaw, weight forces from an implement secured in the coupler are at least partly supported by the lip. Preferably, engagement of the first jaw with an implement pin requires a change in direction of the motion of the first jaw or said implement pin, to clear the lip of the first jaw. Additionally or alternatively, movement of an implement pin onto or off the seat of the first jaw preferably requires movement of the pin or coupler in a direction with a component of motion perpendicular to the movement axis.

In an embodiment, the second jaw comprises a flat extension surface adjacent the second jaw opening, for preventing rotation of an implement attached to the coupler in the event of a failure of the actuator, the extension surface being substantially parallel to the movement axis.

The movable jaw may be provided on a movable member, with the movable member comprising an extension arranged to slidably engage a first cam surface of the first locking member. In an embodiment, the movable member extension is substantially solid, and/or the actuator does not nest in the movable member extension.

In an embodiment, the engagement portion comprises a projection at or near an end of the movable member extension, the projection having a surface slidable along a surface of the first locking member.

In an embodiment, the first locking member has a pivot, the pivot defining a jaw side portion of the first locking member on the side of the pivot nearest the first jaw opening, and a release tab located on the opposite side of the pivot.

A first cam surface may extend along at least a major part of the jaw side portion of the first locking member, and a second cam surface may extend along the release tab, for slidably receiving the movable member extension. In an embodiment, the first cam surface is substantially flat along at least a major part of the jaw side portion of the first locking member, with a depression at or near the transition from the jaw side portion to the release tab.

In an embodiment, the portion of the first locking member that protrudes into the opening of the first jaw comprises an angled leading surface that is angled at a non-perpendicular angle relative to the movement axis. The angled leading surface may be provided by a tapered end of the first locking member.

The second locking member is preferably biased towards its locking position, and wherein the biased locking member is sufficient to support the weight of the movable member and any attached components. For example, a leaf spring may be arranged to bias the second locking member into its locking position.

The second locking member may have an angled leading surface and an angled trailing surface, the leading and trailing surfaces being inclined in opposite directions with respect to the movement axis.

In an embodiment, the first pivoting locking member is shaped to only contact an implement pin seated in the first jaw at or along a single point on the circumference of said implement pin. For example the first pivoting locking member may comprise a substantially planar locking surface for contacting the implement pin seated in the first jaw, or a concave surface.

In an embodiment, the actuator is a linear actuator such as a hydraulic ram.

To those skilled in the art to which the invention relates, many changes in construction and widely differing embodiments and applications of the invention will suggest themselves without departing from the scope of the invention as defined in the appended claims. The disclosures and the descriptions herein are illustrative and are not intended to be in any sense limiting. Where specific integers are mentioned herein which have known equivalents in the art to which this invention relates, such known equivalents are deemed to be incorporated herein as if individually set forth.

The term 'comprising' as used in this specification and claims means 'consisting at least in part of'. When interpreting statements in this specification and claims that include the term 'comprising', other features besides those prefaced by this term can also be present. Related terms such as 'comprise' and 'comprised' are to be interpreted in a similar manner.

It is intended that reference to a range of numbers disclosed herein (for example, 1 to 10) also incorporates reference to all rational numbers within that range and any range of rational numbers within that range (for example, 1 to 6, 1.5 to 5.5 and 3.1 to 10). Therefore, all sub-ranges of all ranges expressly disclosed herein are hereby expressly disclosed.

As used herein the term '(s)' following a noun means the plural and/or singular form of that noun. As used herein the term 'and/or' means 'and' or 'or', or where the context allows, both.

BRIEF DESCRIPTION OF THE DRAWINGS

The present invention will now be described by way of example only and with reference to the accompanying drawings in which:

FIG. 9A shows the coupler in an unlocked configuration, receiving a first one of the pins, FIG. 9B shows the coupler in an retracted configuration in which the coupler is locked to the first pin and ready to receive the second pin, FIG. 9C shows the coupler rotated into alignment with the second pin, and FIG. 9D shows the coupler engaged with the second pin and in a locked configuration such that both pins are locked to the coupler;

FIG. 10A shows the coupler in an unlocked configuration, ready to be attached to the bucket, FIG. 10B shows the coupler in an unlocked configuration, receiving a first one of the pins, FIG. 10C shows the coupler in a retracted configuration in which the coupler is locked to the first pin and ready to receive the second pin, FIG. 10D shows the coupler rotated by the excavator arm, into alignment with the second pin, FIG. 10E shows the coupler engaged with the second pin and in a locked configuration such that both pins are locked to the coupler, and FIG. 10F shows the excavator arm lifting the coupled bucket;

DETAILED DESCRIPTION OF A PREFERRED EMBODIMENT

Figure 1:
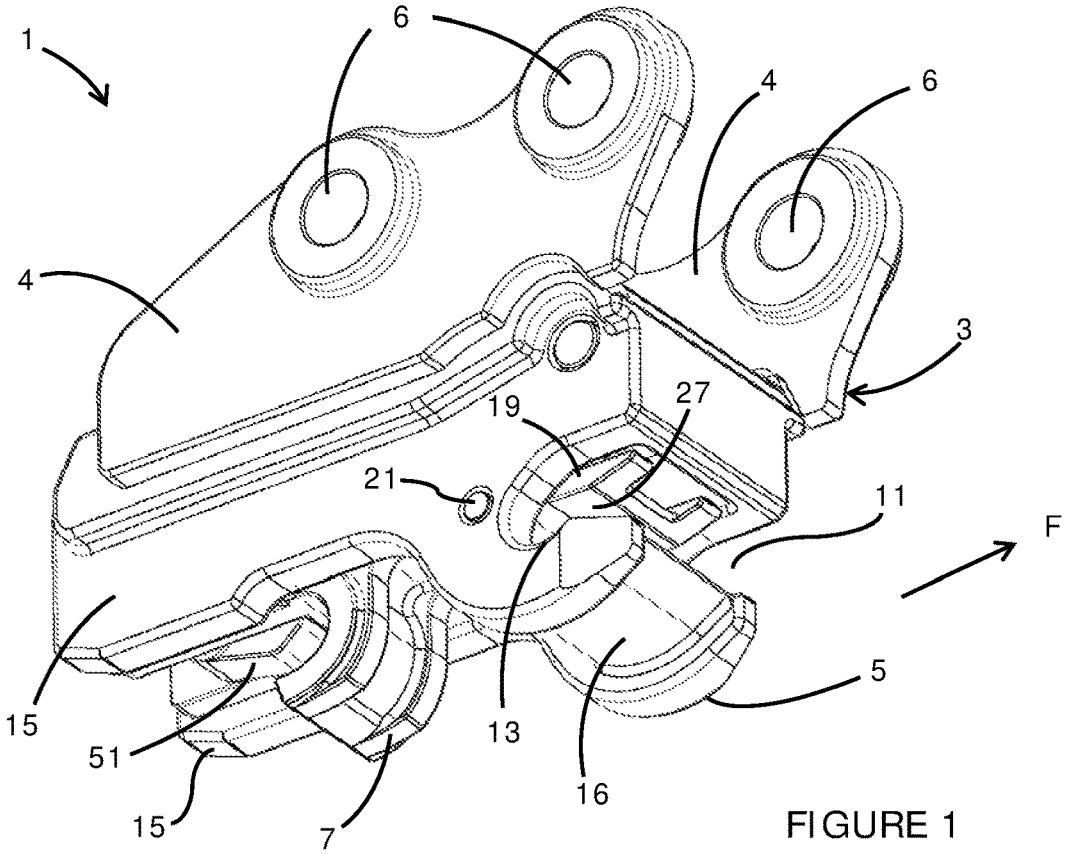
FIG. 1 shows a front/underside perspective view of an exemplary coupler.
Figure 2:
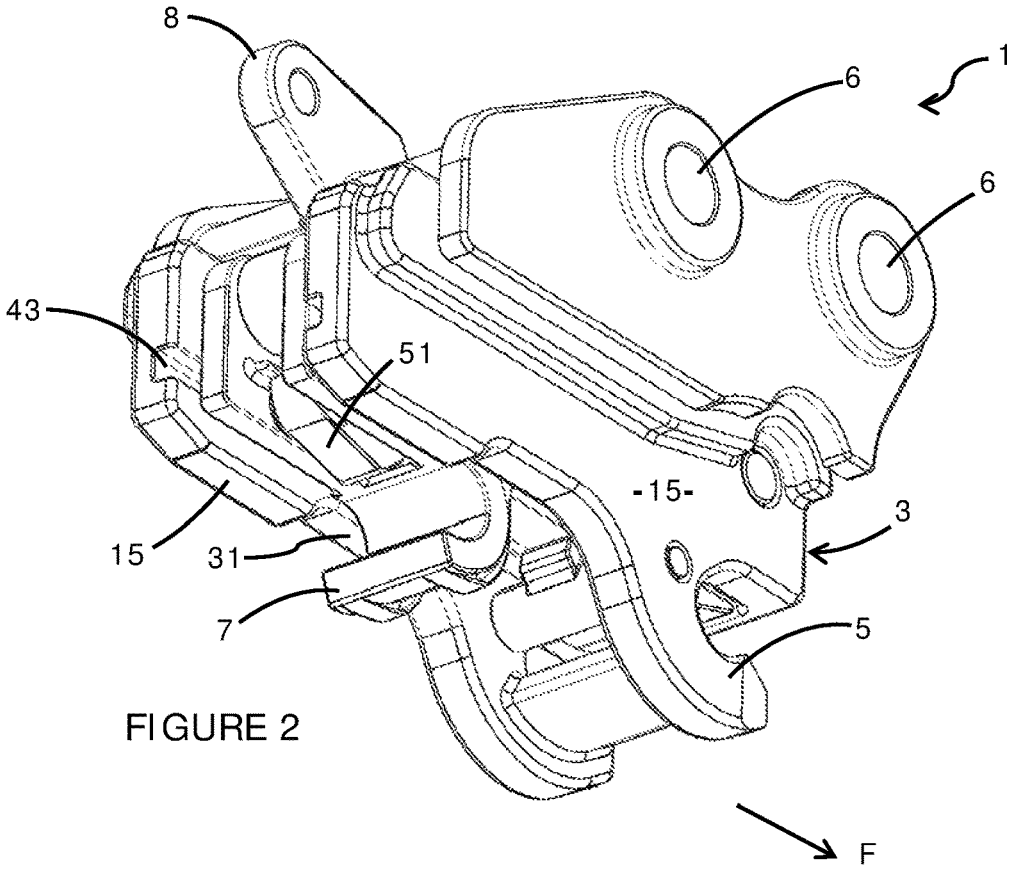
FIG. 2 shows a rear/underside perspective view of the coupler of FIG. 1.

FIGS. 1 to 16 show an exemplary coupler 1 according to one embodiment of the invention. The coupler 1 is suitable for coupling an implement having first and second spaced apart parallel pins 2*a*, 2*b*, to the arm of a vehicle or machine. Transverse parallel pins 2*a*, 2*b* are commonly provided as a standard feature on implements such as excavation buckets, ripping attachments, sieve buckets, clamp, wide buckets, hydraulic hammers, screw augers, etc. to assist with attachment of the implement to an arm/boom on a vehicle or other machine, as shown in FIGS. 11 to 14.

An arrow marked "F" has been inserted into the figures where appropriate to indicate a forward direction of the coupler 1. The front F of the coupler 1 in the embodiment shown is the side corresponding with the front of the implement (the open side of the excavator bucket in FIGS. 10A to 14). The absolute orientation of the coupler 1 will change during the course of its use as the arm to which it is mounted moves. Accordingly the terms forward, rearward, left side, and right side (or similar) should be construed with reference to the forward direction F of the coupler, not necessarily with reference to the orientation shown in a given figure, the use of these terms is for ease of explanation and is not intended to be limiting.

The coupler 1 has a body 3, a first jaw 5 that is fixed relative to the body 3, a movable second jaw 7 that is movable relative to the body, and an actuator 9 operable to selectively move the second jaw 7 towards and away from the first jaw 5. Movement of the second jaw 7 is along a movement path that extends in the longitudinal forward-rearward directions of the coupler, as denoted by the movement axis MA shown in the Figures. The body 3 is configured for attachment to a vehicle or machine arm 71, for example, via attachment features. In the embodiment shown, the body 3 comprises two spaced apart parallel plates 4, to receive an end of the arm or links from the arm between the plates 4. The plates 4 include mounting apertures 6 for bolting the coupler body 3 to the arm or arm links, however other attachment methods are possible. A lifting lug 8 (FIG. 2) is provided, preferably at the aft of the coupler body 3, to facilitate the lifting of various items on the worksite, for example using a chain placed through the aperture in the lug 8.

The first jaw 5 is hook-shaped, defining an opening 11 to the front F of the coupler. An inner surface of the first jaw 5 provides a seat 13 for receiving the first implement pin 2*a*. The first and second implement pins 2*a*, 2*b* are substantially cylindrical, accordingly, the surface of the first jaw 5 providing the seat 13 for the implement pin 2*a* is concave with a curvature that substantially corresponds to that of the pin 2*a*.

In the embodiment shown, the first jaw 5 is provided by hooks extending from two spaced apart side plates 15 that are fixed relative to or integral with the body 3 of the coupler. A web 16 having an upper surface contiguous with the seating surface of the hooks, bridges between the hooks of the two plates 15 to form at least part of the seat for the implement pin 2*a* as well as providing stiffness to the first jaw 5.

Figure 3:
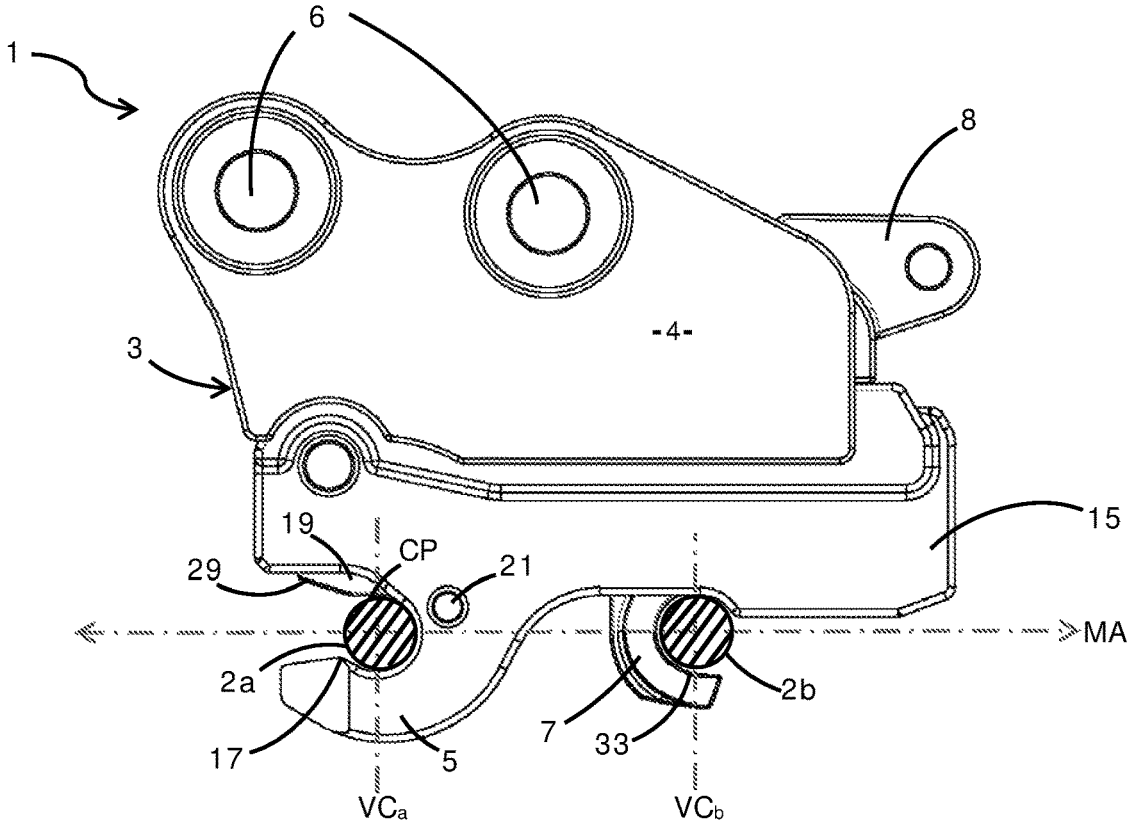
FIG. 3 is a side elevation of the coupler of FIGS. 1 and 2, with the coupler in a locked configuration, engaged with a pair of implement pins.
Figure 4:
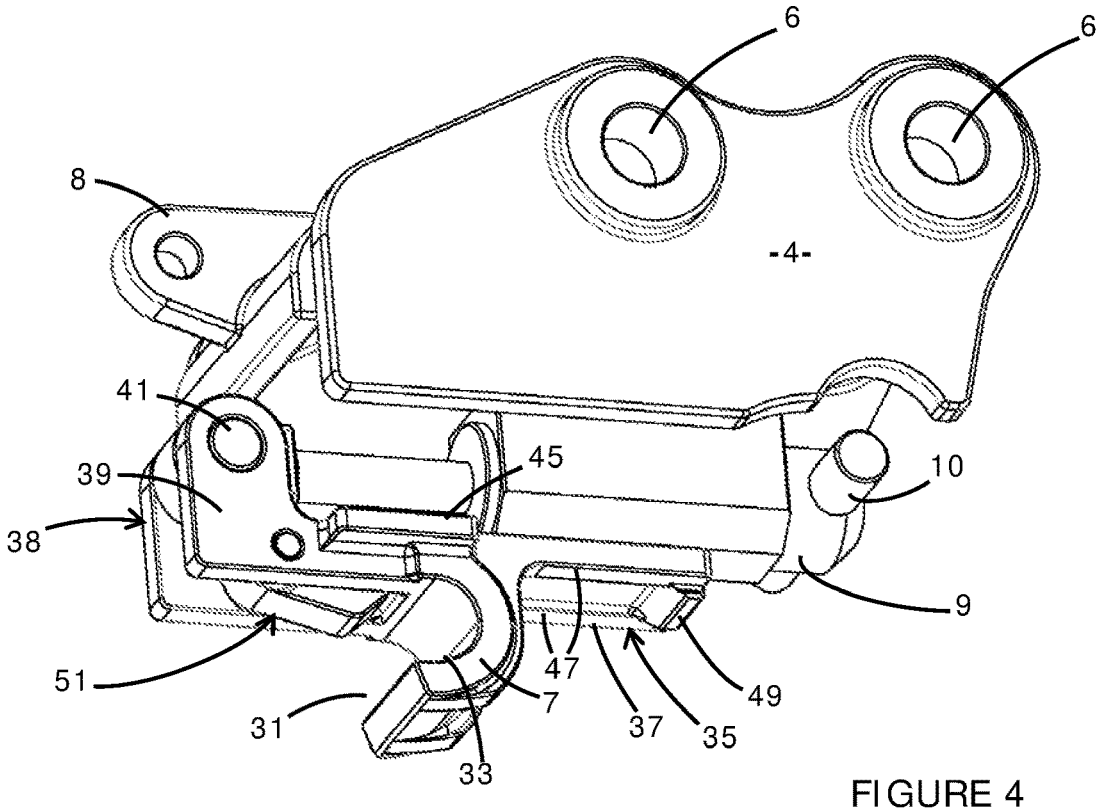
FIG. 4 is a side perspective view of the coupler of FIGS. 1 to 3, with the fixed jaw component and front latch hidden to reveal the movable member, actuator, and second latch.

Referring to FIG. 3, the first jaw 5 includes a raised lip 17 forward of the pin seat 13. The lip 17 protrudes into the opening 11 of the first jaw, reducing the size of the opening adjacent to the lip 17 and defining a recess rear of the lip 17, which forms the seat 13. The lip 17 requires the implement pin 2*a* to navigate a non-linear entry and exit path relative to the coupler 1 on its way through the opening 11 into and out of its fully seated position on the seat 13. That is, for relative movement of the implement pin 2*a* past the lip 17 (or movement of the lip 17 past the implement pin 2*a*), the movement must have a component of movement in a direction perpendicular to the forward-back direction of the coupler 1, it is not possible for the implement pin 2*a* to move into or out of engagement with the first jaw (or for the first jaw 5 to be moved into or out of engagement with an implement pin) by purely 'forward' or 'rearwards' movement that is parallel with the movement axis MA.

In the embodiment shown, the lip 17 is formed by the portion of the first jaw hook that curves around on itself, that is, referring to FIG. 3, the portion of the hook forward of the first pin 2*a* vertical centre line VCa, with the surface of the lip 17 contiguous with the seating surface. However, in alternative embodiments, the lip may instead be a discrete projection. The lip 17 preferably extends across the width of the coupler 1 between the two side plates 15, formed by the web 16.

A first locking member 19 is provided at the first jaw 5. The first locking member 19 is movable between a locking position shown in FIGS. 3, 5 and 7, in which a portion of the locking member 19 protrudes into the opening of the first jaw 5, and an unlocked position shown in FIG. 6, in which the locking member 19 is substantially or wholly retracted from the opening 11 of the first jaw 5. With the first locking member 19 in the unlocked position, the first jaw 5 can be moved into engagement with an implement pin 2*a*, whereas in the locking position, the first locking member 19 prevents entry or exit of an implement pin from the first jaw 5.

The first locking member 19 is pivotable relative to the first jaw 5, for example, by being pivotally mounted to the first jaw 5 or the coupler body 3. In the embodiment shown the pivot of the first locking member 19 is provided by a pin 21 extending between the two side plates 15 of the first jaw, with the first locking member 19 siting between these side plates 15.

Figure 5:
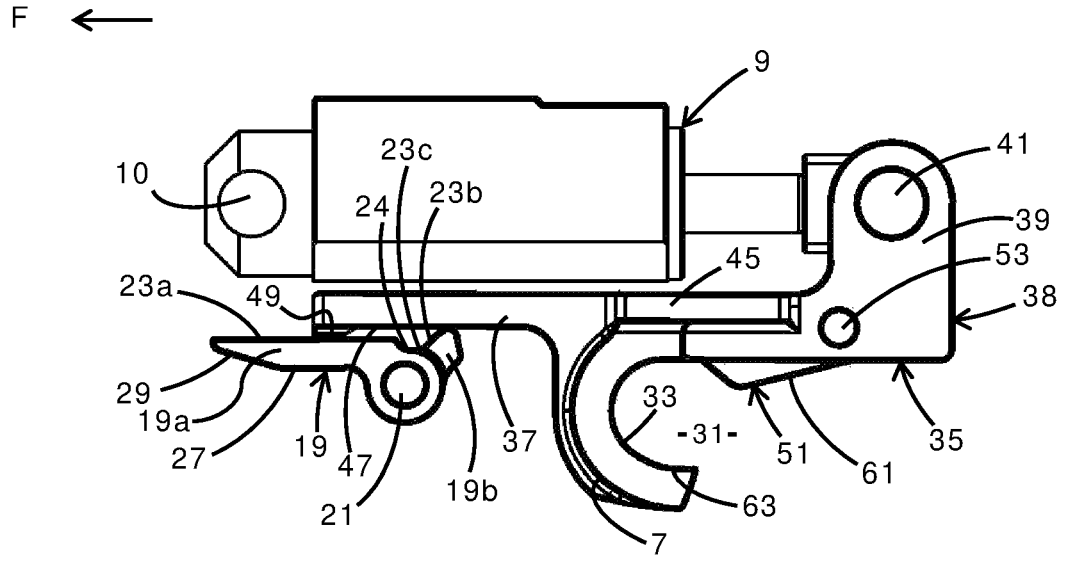
FIG. 5 is a side view of assembled components of the safety mechanism of the coupler of FIGS. 1 to 4, with the second jaw in a partially contracted position.
Figure 6:
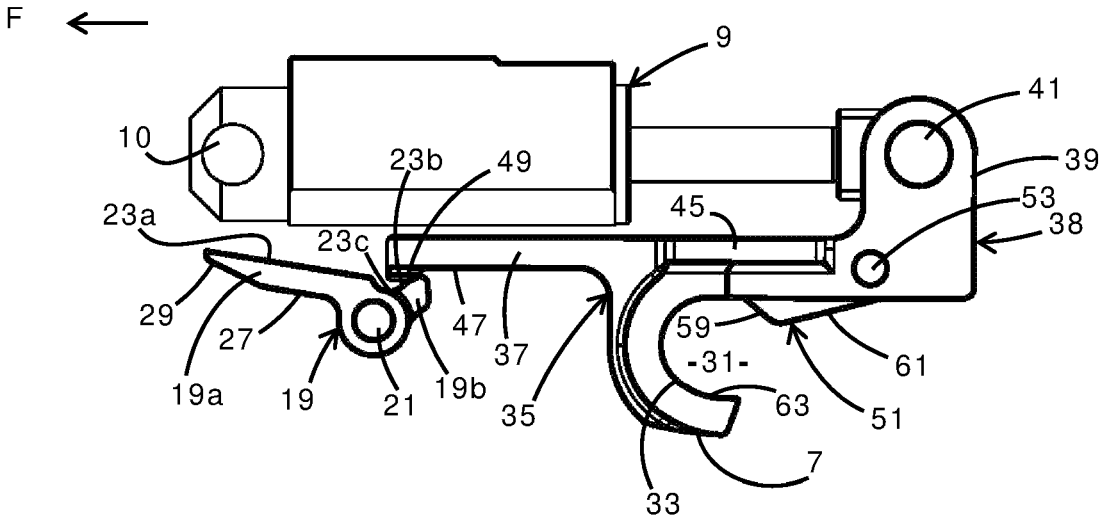
FIG. 6 is a side view of assembled components of the safety mechanism of the coupler of FIGS. 1 to 4, with the second jaw in the extended position.

Referring to FIGS. 5 and 6, the pivot 21 nominally divides the first locking member 19 into a front, jaw-side portion 19*a*, on the side of the pivot 21 nearest the first jaw opening 11, and a release portion 19*b*, located on the opposite side of the pivot 21. The upper surface of the first locking member 19 provides one or more cam surfaces 23*a*, 23*b* for slidably receiving an extension 37 of the movable second jaw 7, as will be explained in more detail below.

A substantially flat first cam surface 23*a* extends along a top of the jaw side portion 19*a* of the first locking member 19. In the embodiment shown, the first cam surface 23*a* extends along a major part of the length of the jaw side portion 19*a*. A second cam surface 23*b* is provided on the release portion 19*b*, and is inclined relative to the first cam surface 23*a*. The first and second cam surfaces 23*a*, 23*b* may be contiguous or separate.

Figure 8:
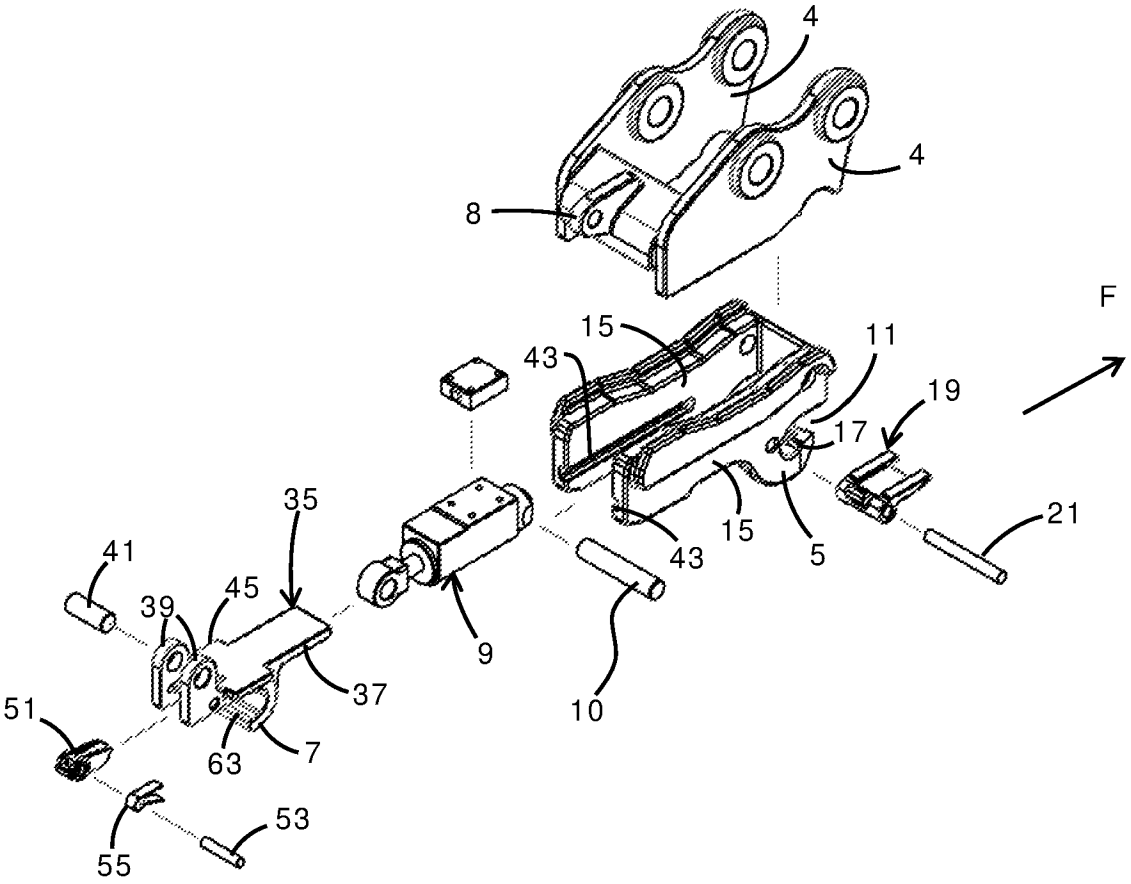
FIG. 8 is an exploded perspective view of the coupler of FIGS. 1 to 6.

Referring to FIG. 8, in the embodiment shown, the first and second cam surfaces 23*a*, 23*b* are separate surfaces. The first locking member 19 comprises two parallel first cam surfaces 23*a* located on raised rails at the sides of the locking member 19. The release portion 19*b* comprises a release tab 25 positioned between but rear of the two first cam surfaces 23*a* with the inclined second cam surface 23*b* provided on the front surface of the release tab 25. At least a front lead-in section 23*c* of the second cam surface 23*b* is concave with a radius of curvature, to provide a gradual transition from sliding of the movable jaw extension 37 along the flat first cam surface 23*a* to the movable jaw extension engaging and sliding along the inclined second cam surface 23*b*. A depression 24 is provided at the end of the first cam surface 23*a*, near the transition from the jaw side portion 19*a* to the release tab 19*b*, for clearance to allow the first locking member 19 to clear the extension 37 of the movable second jaw 7 as it rotates.

The first locking member 19 further comprises a locking surface 27 on a surface of the locking member 19 facing away from the first cam surface 23*a*. The locking surface 27 contacts the implement pin 2*a* when the locking member 19 is in its locking position. The locking surface 27 is located on the portion of the first locking member 19 that protrudes into the opening 11 of the first jaw when the locking member 19 is in its locking position.

The locking surface 27 is shaped to only have a single point of contact with the implement pin 2*a* when engaged in its locking position. In the embodiment shown, a single contact point is achieved through the use of a substantially flat/planar locking surface. When locked against an implement pin 2*a*, the locking surface 27 is tangential to the cylindrical implement pin and so only contacts the pin at a single point CP (see FIGS. 9B and 9C). In alternative embodiments, the locking surface 27 may be alternatively shaped in a manner that still achieves only a single point of contact with the implement pin 2*a*, for example, the locking surface 27 may be convex, or alternatively may be concave but with a radius of curvature that is notably larger than the radius of the implement pin. The most preferred embodiments are those where locking surface 27 is flat or where any curvature is minimal, such that the locking surface does not form a 'hook' shape. Hook-shaped locking surfaces, particularly those that closely follow the curvature of the implement pin 2*b* can trap debris between the locking surface and the implement pin and thereby cause problems when securing the first locking member in position—either preventing the locking member being secured or forcing it into place, resulting in large loads on the locking member and the associated components which can cause potential deformation and/or failure of components.

The first locking member 19 is tapered at its front end, that is, at the end of the locking member most distal to the pivot 21. The taper comprises an angled lead-in surface 29 inclined at a non-perpendicular angle relative to the longitudinal/movement axis MA of the coupler 1. The lead-in surface 29 preferably extends to the top of the jaw opening 11 when the first locking member 19 is in its locking position, so that in the locking position, there is no surface of the first locking member 19 protruding into the first jaw opening, which is perpendicular to the longitudinal/movement axis MA.

A common cause of damage or failure of existing couplers is due to misuse by inexperienced operators, notably by an operator repeatedly and forcefully trying to force a coupler in a locked state into engagement with an implement. In the present embodiment, if an operator attempts to force the coupler 1 into engagement with an implement pin 2*a* while the first locking member 19 is locked in its locking position, the taper 29 on the first locking member means that the force from pressing the coupler 1 into the pin 2*a* is transferred to the locking member 19 as a rotational force, about the pivot 21 and so is resisted by the movable jaw extension 37. This is in contrast to if the locking member comprised a blunt end surface that would transmit the force directly to the pivot pin 21 (which is typically smaller and therefore weaker than the movable jaw extension), potentially causing shearing or deformation of the pin 21.

The movable second jaw 7 is a hook-shaped member, defining an opening 31 and a seat 32 for receiving the second implement pin 2*b*. The second jaw 7 opens to the rear of the coupler 1, that is, the first and second jaws 5, 7 face away from each other in opposing directions. The movable second jaw 7 is movable between an extended position with the second jaw distal to the first jaw, an engagement position in which the first and second jaws 5, 7 engage respective implement pins, and a contracted position with the second jaw proximal the first jaw.

In the extended position, the spacing between virtual centres of the mouth of the fixed jaw 5 and the mouth of the movable jaw 7 is greater than the centre-to-centre spacing of the first and second implement pins 2*a*, 2*b*.

The movable jaw 7 is provided on a movable member 35, the movable jaw 7 being fixed to or integral with the movable member 35. The movable member 35 has an extension 37 that extends forward from the second jaw 7, in an opposite direction to the jaw opening 31, and a drive portion 38 for coupling the movable member 35 to an actuator 9. The movable member 35 is slidably mounted in the coupler 1 for rectilinear movement relative to the coupler body 3, towards and away from the fixed first jaw 5 along a movement axis MA. When the coupler is aligned for engagement with the implement pins 2*a*, 2*b*, movement of the second jaw is perpendicular to the transverse implement pins 2*a*, 2*b*.

In the embodiment shown, the facing inner surfaces of the first jaw side plates 15 each comprise a linear guide channel 43 (see FIG. 8). These guide channels 43 receive complementary guide features on the movable member, for example, guide tabs 45, which project laterally from the movable member 35. As the movable member is moved forward or rearward by the actuator 9, the movable member 35 guide tabs 45 slide forward and rearwards in the guide channels 43, to guide and constraining the motion of the movable second jaw 7. The guide channels 43 may comprise stops to define a limit of travel of the movable member 35, or alternatively the travel of the movable member may be determined by other constraints such as the stroke of the actuator 9.

The movable member extension 37 is located above the first and second jaw openings 11, 31, but below the actuator 9 (when the coupler is oriented as shown in FIGS. 1 to 8). The extension 37 is arranged to interact with the first locking member 19, particularly by being in sliding contact with the cam surfaces 23*a*, 23*b*. The extension 37 has an engagement portion comprising a surface on the underside of the extension 37 that is in sliding contact with the flat first cam surface 23*a*. As the movable jaw 7 moves towards the fixed jaw 5, the movable member extension 37 slides over the first locking member 19.

The engagement portion further comprises a protrusion 49 on an underside at or near the end of the movable member extension 37, for interacting with the release portion 19*b* of the first locking member 19. The protrusion 49 has an inclined surface with a curved tip for sliding engagement with the release portion 19*b* of the first locking member 19. The angle or curvature of the inclined surface preferably is substantially the same as the angle or curvature of the inclined surface on the release portion 19*b*.

As the movable jaw 7 moves away from the fixed jaw 5, the protrusion 49 moves towards and into contact with the release portion 19*b*, with continued movement of the protrusion 49 causing the protrusion to slide along the inclined surface of the release portion 19*b* to rotate the first locking member 19. Preferably when the movable jaw 7 is in its extended position the projection 49 is still in contact with the release portion of the first locking member 19, to hold the first locking member in its unlocked position.

The movable member extension 35 preferably has a substantially solid body that lies adjacent to the actuator 9. The solid body strengthens the coupler, and helps ensure the coupler is robust, especially when subject to misuse. Some existing couplers contain hollow or frame-like movable components in which the actuator nests. Such components are prone to failing.

In the embodiment shown, the drive portion 38 is provided forward of the second jaw opening 31 and comprises left and right side ears 39 with an actuator coupling pin 41 extending between the ears. It will be appreciated that in alternative embodiments, the coupling portion may take a different form or be otherwise positioned on the movable member 35.

The actuator 9 is a linear actuator, preferably in the form of a double acting hydraulic ram. The actuator 9 is housed by the coupler body 3 between the first jaw side plates 15. One end of the actuator is fixed relative to the coupler body 3, and its other end is fixed to the movable member. In the embodiment shown, the cylinder of the hydraulic ram 9 is pinned to the first jaw side plates 15 via a pin 10, and the hydraulic ram rod is pinned 41 to the movable member 35.

Preferably the ram of the hydraulic cylinder 9 is not mechanically biased into an extended (or contracted) position. In some existing couplers the coupler safety feature is provided by mechanically biasing the actuator into an extended position to ensure it remains extended in the occurrence of loss of hydraulic pressure, for example using a spring on the rod. Designs relying on mechanically biasing the actuator have a number of disadvantages, for example, the components must be stronger to accommodate the larger forces required for the hydraulic ram to act against the bias of such a spring (for example during uncoupling). In addition, the working environment regularly contains debris which can easily become entrapped and hinder the proper operation of cause failure of the spring biasing the ram. As such springs are often contained within the coupler housing or internally in the actuator, it is difficult to monitor the condition of the springs to know if they are fit for purpose, or for maintenance purposes A second locking member 51 is provided at the movable second jaw 7. The second locking member 51 is pivotable relative to the second jaw 7, between a locking position in which a portion of the second locking member 51 constricts the opening 31 of the second jaw 7, and an unlocked position, in which the second locking member 51 is substantially or wholly retracted from the opening 31.

In the embodiment shown, the second locking member 51 is pivotally mounted to the movable member 35 via a pivot pin 53, such that the second locking member 51 moves forwards and rearwards relative to the first jaw 5 in tandem with the movable member 35 and second jaw 7. The second locking member 51 is biased into its locking position by a spring 55. The spring 55 acts between a reaction surface of the movable member 35 and the second locking member 51, to urge the second locking member away from the movable member. A stop 57 (see FIG. 7) provided on the movable member 35 abuts a surface on the second locking member 51 when the second locking member reaches the locking position to limit rotation of the second locking member 51 beyond this point.

In the embodiment shown, the spring 55 is a leaf spring that extends around the second locking member pivot 53. A leaf spring is less susceptible to becoming jammed with grit or dirt compared to other spring types, so is less likely to fail or jam when the coupler 1 is used in a dusty environment. In alternative embodiments, the spring 55 may instead comprise a torsion spring positioned around the pivot 53, a compression spring between the locking member 51 and the movable member 35, or another suitable biasing component.

Only a single spring is shown in the embodiment of the drawings, but alternatively there may be a plurality of springs 55 biasing the second locking member 51.

The second locking member 51 can be moved from its locking position into its unlocked position by pushing the second locking member 51 in, against the spring force, towards the movable member 35. The underside of the second locking member 51 has an angled leading surface 59 and an angled trailing surface 61. The surfaces 59, 61 are angled at non-perpendicular angles to the movement axis MA, for example, each surface being oppositely inclined at an angle of between 20 and 60 degrees, preferably between 30 and 50 degrees. The angled surfaces 59, 61 ensure that when a force parallel with the movement axis is applied to the second locking member 51, the force acts about the pivot 58, thereby causing the locking member to rotate towards the unlocked position if the force is high enough to overcome the bias of the spring 55.

As will be described in more detail below, the second locking member 51 is a safety feature to ensure the second jaw 7 remains attached to the second implement pin **2*b* in the case of a loss of hydraulic pressure in the actuator 9. The second locking member 51 constricts the opening 31 of the second jaw, such that the second jaw will not slide off the second implement pin in such an event. The bias force from the spring 55 should at least be sufficient that the weight force from the movable member 35 will not cause the second locking member 51 to rotate to the unlocked position when the leading surface 59 bears against the implement pin 2*b***.

Operation of the coupler will now be described with reference to FIGS. 9A to 9D and 10A to 10F. FIGS. 10A to 10F show the coupler attached to the end of an arm 71 of an excavator. The arm 71 includes a linkage to which the coupler 1 is attached via the mounting apertures 6. The linkage can be manipulated using a hydraulic ram, to move the linkage and thereby the coupler 1.

Figure 9A:
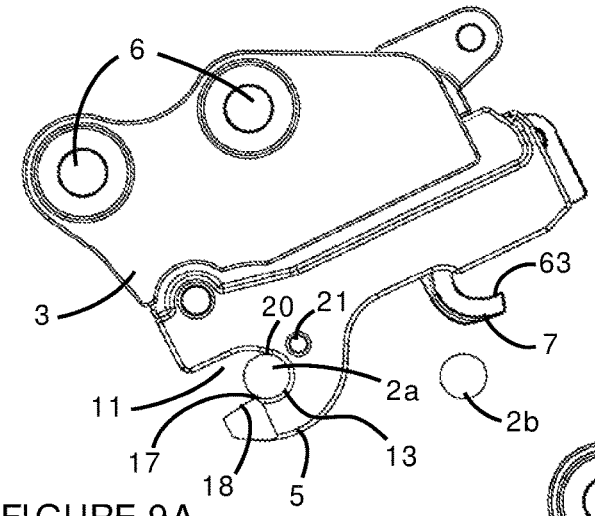
FIGS. 9A to 9D are side elevation views showing the steps to couple the coupler to parallel pins on an implement, where

As shown in FIGS. 9A, 10A, and 10B, before the coupler 1 can be coupled to an implement, it is necessary to ensure that the first locking member 19 is in its unlocked position so an implement pin can enter the first jaw 5. The first locking member 19 is moved to the unlocked position by extending the actuator 9 and thereby moving the second jaw 7 and movable member 35 away from the first jaw 5, to the extended position (also shown in FIG. 6). As the movable member 35 moves towards the extended position, the protrusion 49 on the engagement portion moves into contact with the inclined cam surface **23*b* on the release tab 25 of the first locking member 19. As the movable member 35 moves into the extended position, the protrusion 49 slides over the release tab surface 35, rotating the release tab downwards and correspondingly rotating the main body of the first locking member 19** upwards and into the unlocked position.

With the coupler 1 in this unlocked configuration, the coupler as a whole can be moved and, if necessary, rotated using the linkage on the arm 71 to align the first jaw 5 with the first implement pin **2*a* but keeping the second jaw 7 free of the second implement pin 2*b*. The coupler 1 is then moved so the first jaw 5 engages the first implement pin 2*a* with the pin 2*a* seated on the seating surface 13, behind the jaw lip 17. A chamfer or angled surface 18 on the first jaw forward of the lip 17 helps to guide the first jaw 5 onto the pin 2*a* by creating an entrance to the first jaw that is wider than the pin diameter, gradually narrowing to the jaw opening adjacent the lip 17. An angled inner upper surface 20 rear of the lip 17 then guides the pin 2*a* towards the seat surface 13**.

Relative motion between the first implement pin **2*a* and the first jaw 5 is non-linear as they are moved into or out of engagement because the lip 17 necessitates a change in direction of the movement. Relative motion between the first implement pin 2***a* and the first jaw 5 may be linear and parallel with the movement axis MA forward of the lip 17, or may be at a slight angle as accommodated by the chamfer 18 at the front of the first jaw 5. However, rear of the lip 17, between the lip 17 and the seating surface 13, the movement vector changes and requires a direction component that is perpendicular to the movement axis MA.

Once the first pin 2*a* is seated in the first jaw 5, the actuator 9 is retracted to move the movable member 35 and the associated second jaw 7 towards the fixed first jaw 5. As the movable member 35 moves out of the extended position, the slide surfaces 47 (FIG. 4) on the movable member extension 35 move into contact with the respective flat cam surfaces 23*a* on the jaw side 19*a* of the first locking member 19. The slide surfaces 47 slide over the flat cam surfaces 23*a*, rotating the main body of the first locking member 19 downwards and into the locked position. This movement of the first locking member 19 into its locking position occurs when the second jaw 7 is at an intermediate position, between its extended position and its contracted position. The intermediate position may correspond to an engagement spacing of the first and second jaws (the, or may be between the engagement position and the extended position.

In the locking position, the first locking member 19 protrudes into the opening of the first jaw 5, contacting the first implement pin 2*a* at a contact point CP to secure the coupler 1 to the first pin 2*a*. In this configuration, the coupler 1 can't be removed from the first pin 2*a* because the first locking member 19 is constricting the opening 11 of the first jaw 5 such that the width of the opening between the first jaw lip 17 and the locking member locking surface 27 is less than the diameter of the first pin 2*a*, preventing movement of the first pin 2*a* past the lip 17.

Figure 9B:
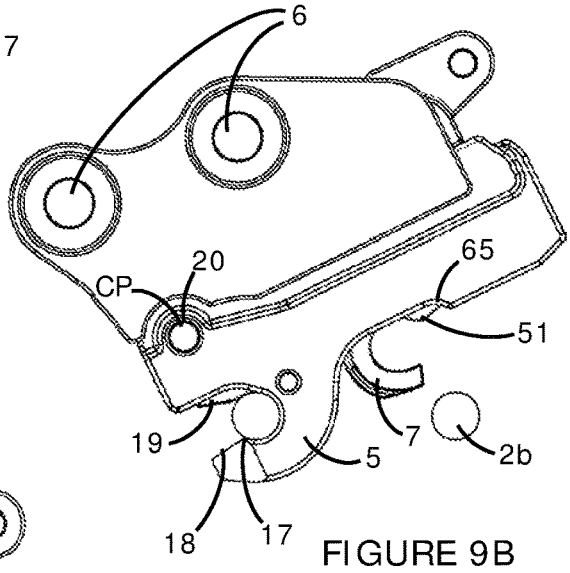
Figure 9C:
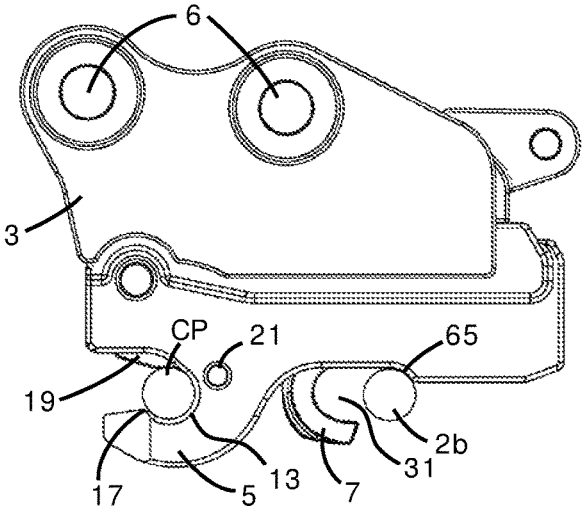
Figure 9D:
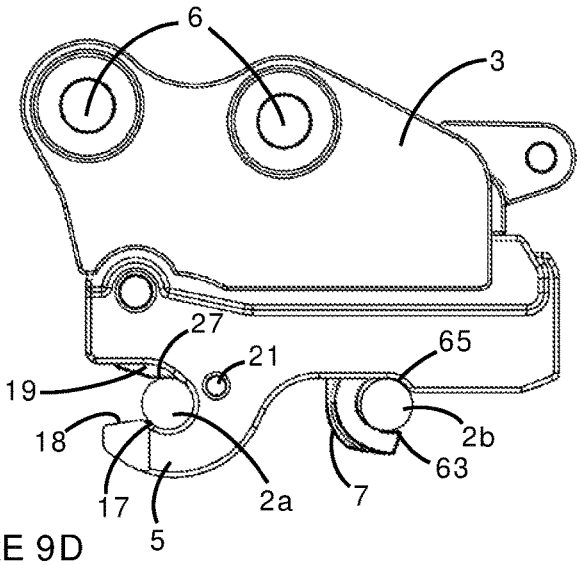
Figure 10:
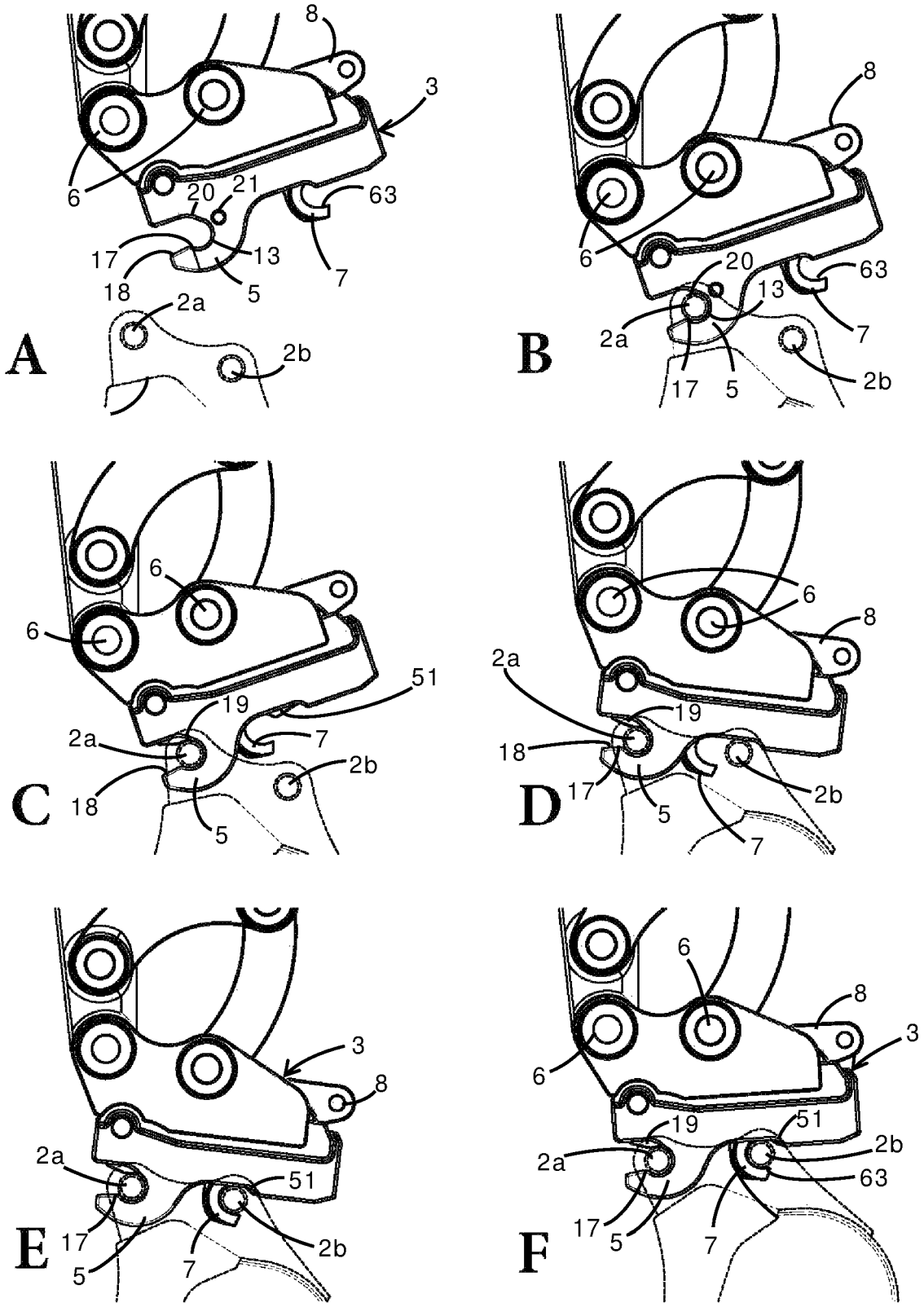
FIGS. 10A to 10F are side elevation views showing the process of coupling the coupler of FIGS. 1 to 8, attached to the end of an arm of an excavator, to parallel pins on an excavator bucket, where
Figure 12:
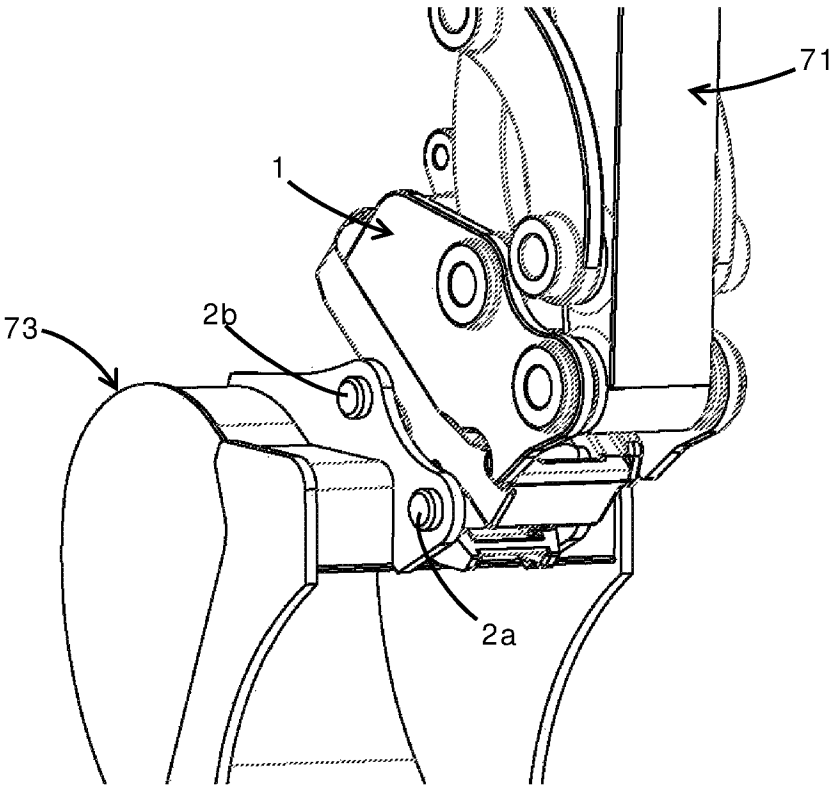
FIG. 12 is a front perspective view of the coupling between the excavator arm and excavator bucket, with the bucket rotated rearwards.
Figure 11:
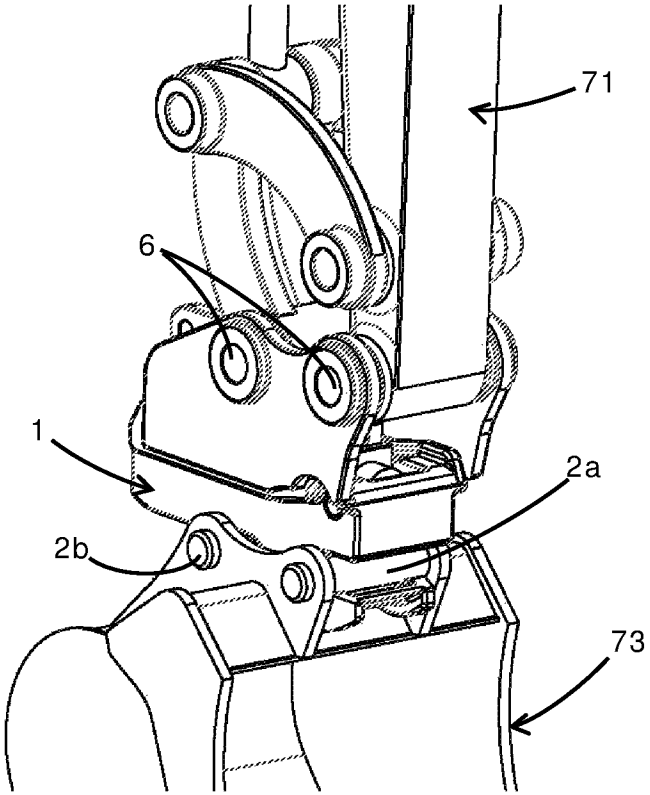
FIG. 11 is a front perspective view of the coupling between the excavator arm and excavator bucket, in the pick-up position of FIG. 10E.
Figure 14:
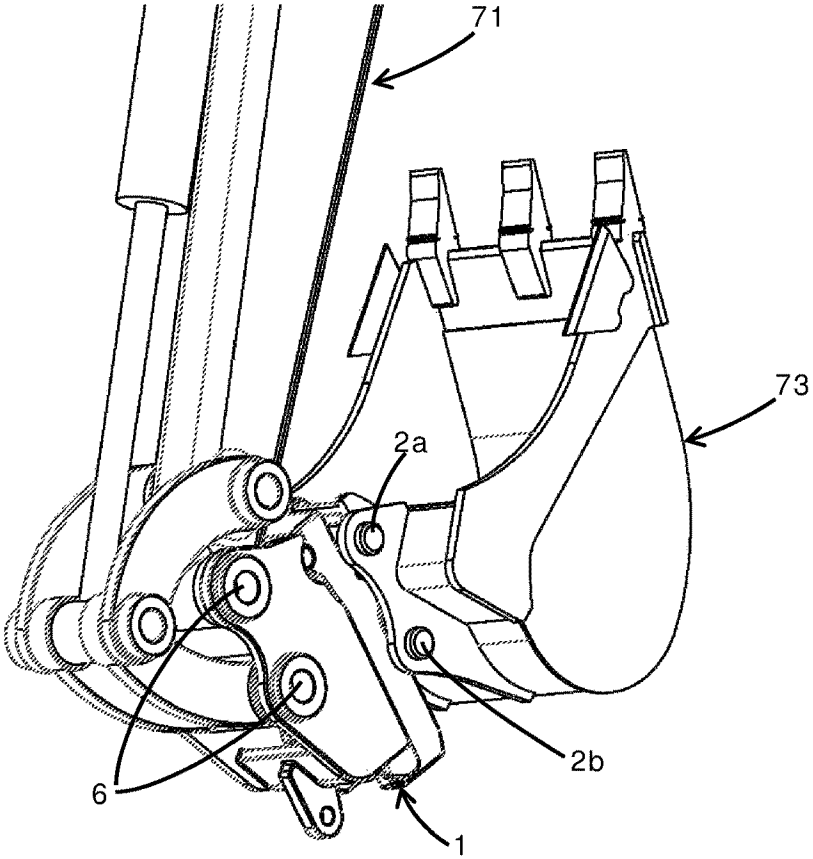
FIG. 14 is a rear perspective view corresponding to FIG. 13.
Figure 13:
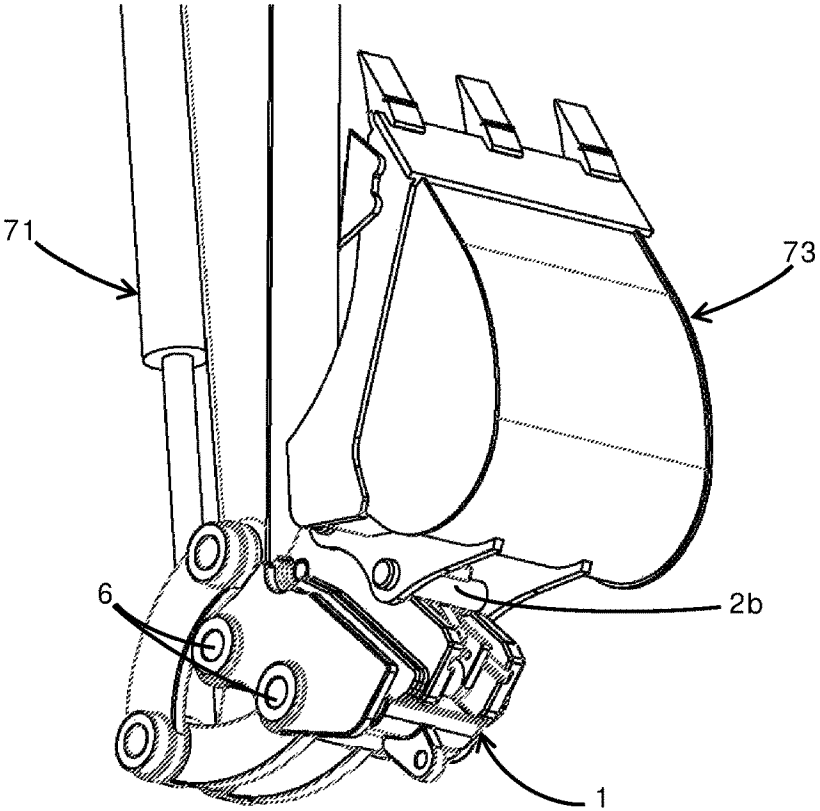
FIG. 13 is a front perspective view of the coupling between the excavator arm and excavator bucket, with the bucket rotated forwards.

When the second jaw 7 is in the extended position, the engagement position, or the intermediate position, the coupler 1 is unable to be rotated downwards to the orientation of FIGS. 9C and 10D because the second jaw 7 will not clear the second implement pin 2*b*. Therefore, from the intermediate position with the first locking member 19 in the locked position, the movable member 35 and second jaw 7 continue to move towards the contracted position as the actuator 9 is retracted. Due to the flat nature of the cam surface 23*a* on the jaw side of the first locking member 19, this continued movement does not cause further rotation of the first locking member 19.

Figure 7:
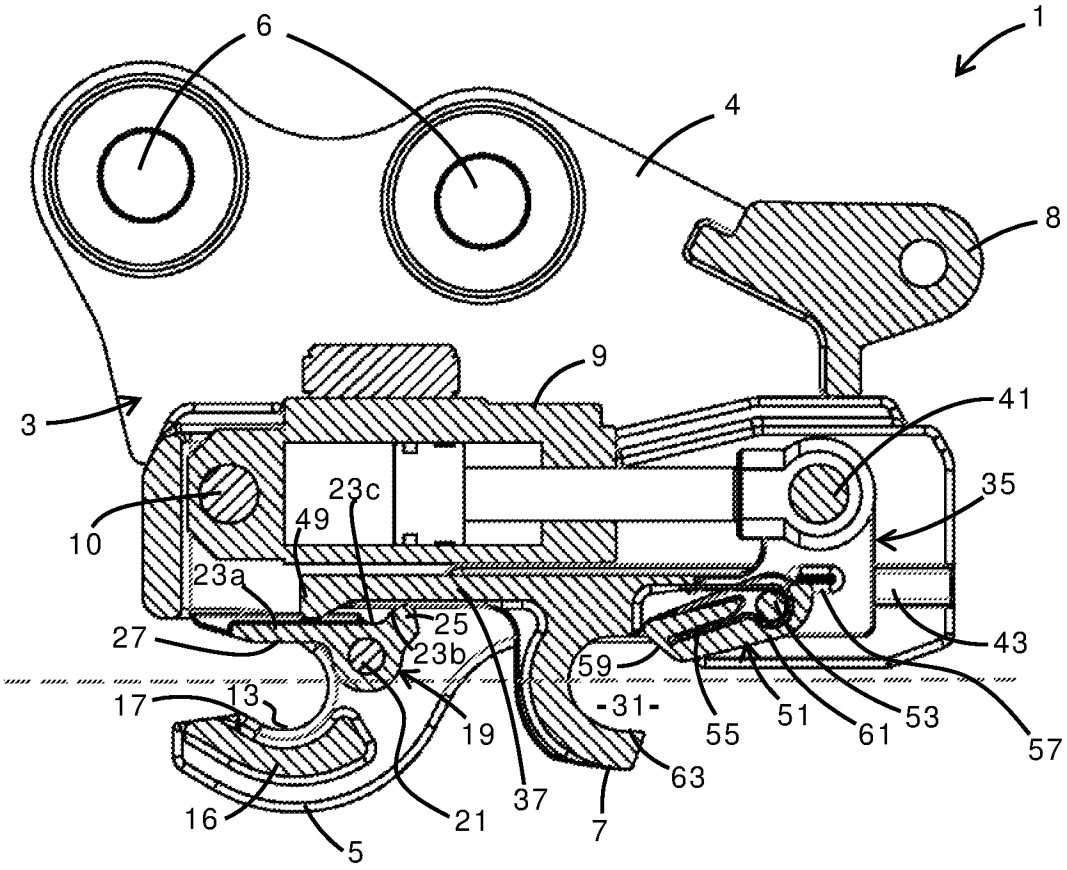
FIG. 7 is a side section view of the coupler of FIGS. 1 to 6, taken through a mid-plane of the coupler.

Once the second jaw 7 reaches its contracted position as shown in FIGS. 7, 9B, and 10C, the second jaw 7 is out of the way of the second implement pin 2*b*. The coupler 1 is then rotated about the first pin 2*a*, until an under surface of the side plates 15 of the first jaw abut the second pin 2*b*, as shown in FIGS. 9C and 10D, and the second jaw 7 is forward of and aligned with the second implement pin 2*b*. The first jaw side plates 15 or the coupler body 3 comprise a recess 65 to locate the second pin 2*b*. During this step, the angled rear 'trailing' surface of the second locking member 51 moves into contact with the second pin 2*b*. As the coupler is lowered onto the second pin 2*b*, the second locking member 51 is pushed by the second pin 2*b* into a retracted/unlocked position against the bias of the spring 55.

In a final step, the actuator 9 is once again extended, moving the second jaw 7 away from the first jaw 5, until the second jaw 7 engages the second pin 2*b*. As the second jaw is moved to this extended position, the second locking member 51 moves over the second pin 2*b*, gradually pivoting down into its locking position under the bias from the spring 55, as allowed by the angled front 'leading' surface 59. The coupler 1 is in its final coupled configuration when the second pin 2*b* is seated on the seating surface 33 of the movable second jaw 7 and the second locking member 51 is fully biased into its locking position with the leading surface 59 of the second locking member contacting the second pin 2*b* at a single contact point. Therefore, the operation of both the forward and rearward safety mechanisms, that is the first locking member 19 on the fixed first jaw 5 and the second locking member 51 on the movable second jaw 7, are operated by movement of the movable member 35 via the actuator 9. No other active actuators such as additional hydraulic rams or solenoids etc are required to operate the first and second locking members 19, 51, nor is any mechanical biasing of the actuator 9 necessary, making the coupler mechanically simple, easy to visually inspect, and robust.

Once the pins 2*a* and 2*b* are engaged with the coupler 1, with the first and second locking members in their locking positions, the implement 73 can be manipulated using the arm or boom 71 to which the coupler 1 is attached, as shown in FIGS. 10F to 14. The first and second locking members 19, 51 prevent the first and second implement pins 2*a*, 2*b* falling out of engagement with the coupler 1 should there be a failure of the coupler such as a loss of hydraulic pressure in the actuator 9.

Figure 15:
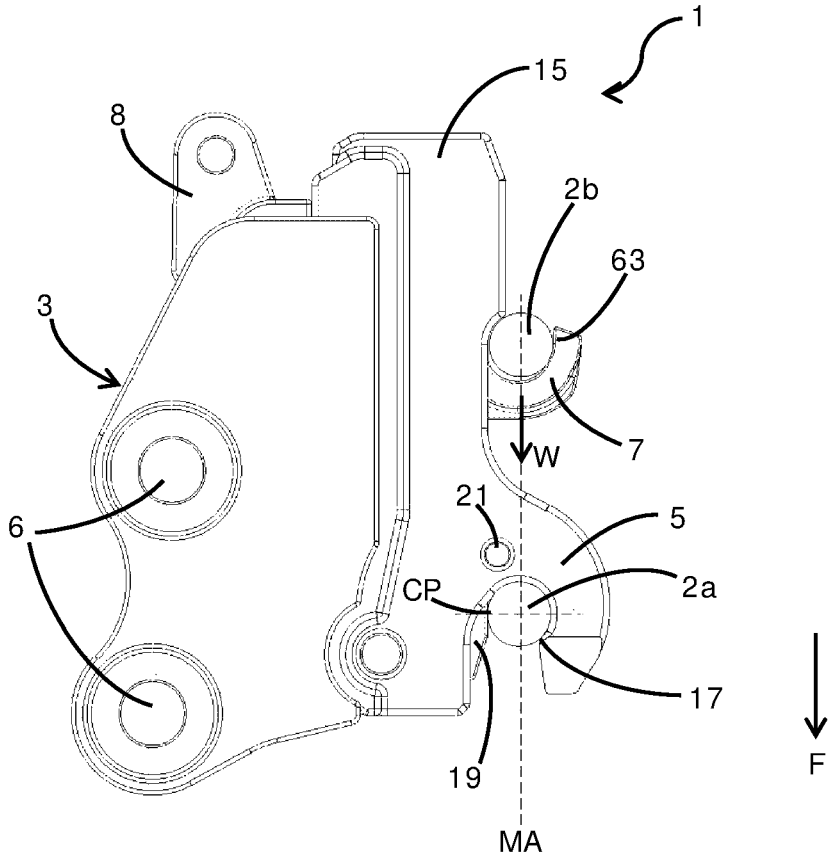
FIG. 15 is a side view of the coupler of FIGS. 1 to 9D, oriented vertically in an orientation corresponding to an in-use position where an attached implement is most outstretched.
Figure 16:
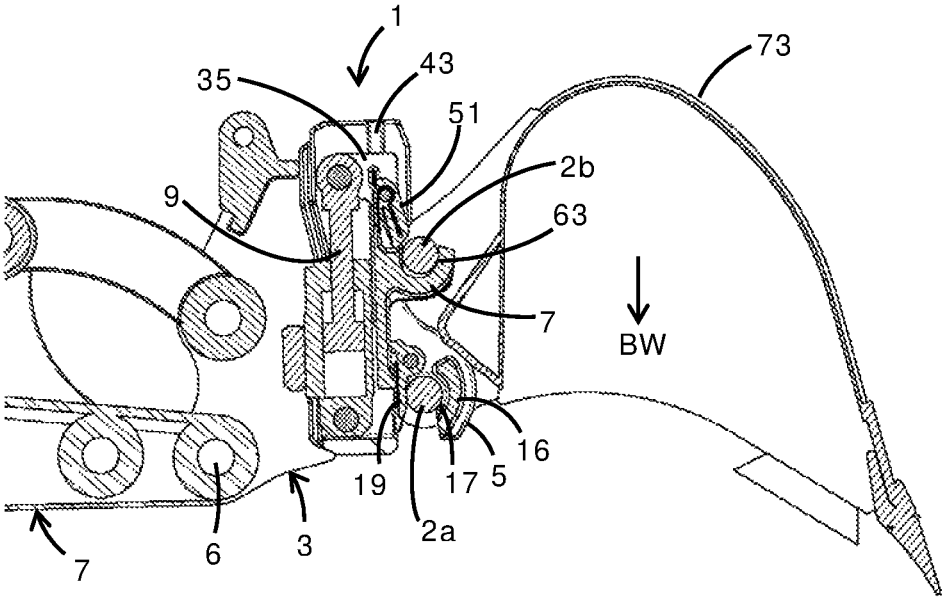
FIG. 16 is a side section view of the coupler of FIGS. 1 to 9D, in the orientation shown in FIG. 15 but additionally showing the coupler attached to the end of an arm of an excavator and coupled to parallel pins on an excavator bucket.

A worst-case failure scenario occurs when the vehicle or machinery arm 71 is outstretched, with the implement pins 2*a*, 2*b* vertically aligned as shown in FIGS. 15 and 16. In this scenario, should there be a complete hydraulic pressure loss to the actuator 9, the first implement pin 2*a*, will remain secure in the first jaw 5. The first locking member 19 will remain in its locking position, prevented from rotating out of its locking position by the movable member extension 37. The constriction in the first jaw opening created by the first locking member 19 and the lip 17, prevents the first implement pin exiting the first jaw 5. The lip 17 carries the weight force of the implement 73, with negligible weight force transmitted to the first locking member 19.

In this vertical orientation, the self-weight W of the movable member 35 and second jaw 7 (and potentially the weight of actuator rod and other connected components) act to urge the movable member 35 downwards. The angled leading surface 59 of the second locking member 51 (see FIG. 16) contacts the second pin 2*b* to counter this weight force and prevent or limit any downward movement of the movable member 35. Since substantially all of the weight of the implement 73 is carried by the lip 17 of the first jaw, it is only necessary for the spring bias to be sufficient to support the weight of the movable member and the attached components, with an allowance for a factor of safety.

In this outstretched position, the centre of mass of the implement 73 is spaced from the coupler 1 (to the right of the coupler 1 as illustrated in FIG. 16). Therefore, the weight force BW from the implement 73 acts rotationally about the first implement pin 2*a*.

To ensure any rotational forces cannot be transferred to the movable member along the movement axis MA, the movable second jaw 7 comprises an extension portion with a flat surface 63 that is parallel to the movement axis MA. This flat surface 63 preferably extends tangentially from the semi-cylindrical second jaw seating surface 13.

The flat surface 63 of the extension portion provides a reaction surface for the rotational force. Since the reaction force will be perpendicular to the movement axis MA (i.e. horizontal in the scenario of FIGS. 15 and 16), it does not cause movement of the movable member 35 along the movement axis MA and instead is transferred to the coupler body 3. In the embodiment shown, the reaction force is transferred to the coupler body via the guide tabs 45 on the movable member. Therefore, both pins 2*a*, 2*b* are retained in the coupler 1 in the event of a hydraulic failure, for all possible orientations of the implement.

In order to uncouple an implement 73 from the coupler 1, the above described process is performed in reverse. As a first step, it is necessary for the second movable jaw to be moved out of engagement with the second implement pin 2*b*. To do this, the force applied to the movable member 35 by retracting the actuator 9 must be sufficient to overcome the bias from the spring 55 on the second locking member 51. The angled leading surface 59 of the locking member 51 means the rectilinear translation of the movable member 35 relative to the implement pin 2*b* causes the second locking member 51 to pivot about its pivot 53 into its unlocked position. During the uncoupling process, it is expected that full hydraulic power will be available to the actuator 9. Accordingly, it will not be difficult for actuator 9 to provide the necessary force to overcome the spring bias and rotate the second locking member 51 to its retracted locked position.

Once the movable jaw 7 is disengaged from the second implement pin 2*b*, the coupler 1 can be rotated about the first pin 2*a* so the second jaw 7 is clear of the second implement pin. The first locking member is then unlocked by moving the movable member and the second jaw 7 into the extended position, rotating the first locking member out of engagement with the first pin, so that the coupler can be removed from the first pin 2*a*.

In some embodiments, it may be desirable to provide hydraulic power to the coupled implement 73. Provision of hydraulic power to an implement 73 may be via separate hose connections that are manually connected, or more preferably there are a number of quick connect hydraulic couplers available in the industry that may be incorporated into the coupler 1, to allow both hydraulic coupling to occur when mechanically coupling the implement.

The components of the coupler 1 may comprise any suitable material as will be apparent to a person skilled in the art. For example, the main components such as the housing body 3, the jaw plates 15, the movable member 35, and the locking members 19, 51 preferably comprise steel. The components can be machined or cast, or a mixture of both. However, it is envisaged that some or all components may comprise alternative materials such as alternative metals or composite materials. Similarly the hydraulic actuator arrangement can comprise any suitable materials and is adapted to be associated with pressure hose.

To those skilled in the art to which the invention relates, many changes in construction and widely differing embodiments and applications of the invention will suggest themselves without departing from the scope of the invention as defined in the appended claims. For example, it will be apparent that although the first jaw 5 is described as the front jaw in the exemplary embodiment, the first jaw 5 may instead be the rear jaw and the second jaw 7 may be forward of the first jaw.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention claimed is:

1. A coupler for coupling an implement having first and second spaced apart parallel pins, to an arm of a vehicle or machine, the coupler comprising:

a body for attaching to the vehicle or machine arm;

a first jaw fixed relative to the body, defining an opening and a seat for receiving the first implement pin, a movable second jaw, defining an opening and a seat for receiving the second implement pin, the first and second jaws facing away from each other;

an actuator operable to selectively move the second jaw towards and away from the first jaw along a movement axis, between an extended position with the second jaw distal to the first jaw and a contracted position with the second jaw proximal the first jaw;

a first locking member that is movable relative to the first jaw between a locking position, in which a portion of the first locking member protrudes into the opening of the first jaw, and an unlocked position, in which the locking member is substantially or wholly retracted from the opening of the first jaw, and a second locking member that is pivotable relative to the second jaw between a locking position in which a portion of the second locking member constricts the opening of the second jaw, and an unlocked position, in which the second locking member is substantially or wholly retracted from the opening of the second jaw;

wherein movement of the second jaw from the extended position, towards the contracted position causes movement of the first locking member from the unlocked position towards the locked position; and wherein the first jaw includes a lip forward of the seat for the first pin, the lip protruding in a direction generally towards the first locking member; and wherein the second jaw comprises a flat extension surface adjacent the second jaw opening and that is substantially parallel to the movement axis, for preventing rotation of an implement attached to the coupler in the event of a failure of the actuator.

2. The coupler as claimed in claim 1, wherein the lip of the first jaw is shaped such that, in a vertical orientation of the coupler with the second jaw above the first jaw, weight forces from an implement secured in the coupler are at least partly supported by the lip.

3. The coupler as claimed in claim 1, wherein the first locking member is pivotable relative to the first jaw between the locking position and the unlocked position.

4. The coupler as claimed in claim 1, wherein engagement of the first jaw with an implement pin requires a change in direction of the motion of the first jaw or said implement pin, to clear the lip of the first jaw.

5. The coupler as claimed in claim 4, wherein movement of an implement pin onto or off the seat of the first jaw requires movement of the pin or coupler in a direction with a component of motion perpendicular to the movement axis.

6. The coupler as claimed in claim 1, wherein the movable jaw is provided on a movable member, and the movable member comprises an extension arranged to slidably engage a first cam surface of the first locking member.

7. The coupler as claimed in claim 6, wherein the movable member extension is substantially solid.

8. The coupler as claimed in claim 6, wherein the actuator does not nest in the movable member extension.

9. The coupler as claimed in claim 6, wherein the movable member extension comprises an engagement portion having a projection at or near an end of the movable member extension, the projection having a surface slidable along a surface of the first locking member.

10. The coupler as claimed in claim 1, wherein the first locking member has a pivot, the pivot defining a jaw side portion of the first locking member on the side of the pivot nearest the first jaw opening, and a release tab located on the opposite side of the pivot.

11. The coupler as claimed in claim 10, wherein the first locking member has a first cam surface that extends along at least a major part of the jaw side portion, and a second cam surface that extends along the release tab, for slidably receiving the movable member extension.

12. The coupler as claimed in claim 11, wherein the first cam surface is substantially flat along at least a major part of the jaw side portion of the first locking member, with a depression at or near the transition from the jaw side portion to the release tab.

13. The coupler as claimed in claim 1, wherein the portion of the first locking member that protrudes into the opening of the first jaw comprises an angled leading surface that is angled at a non-perpendicular angle relative to the movement axis.

14. The coupler as claimed in claim 13, wherein the angled leading surface is provided by a tapered end of the first locking member.

15. The coupler as claimed in claim 13, wherein the first locking member does not have a hook-type shape.

16. The coupler as claimed in claim 1, wherein the second locking member is biased towards its locking position, and wherein the biased locking member is sufficient to support the weight of the movable member and any attached components.

17. The coupler as claimed in claim 1, wherein the second locking member comprises an angled leading surface and an angled trailing surface, the leading and trailing surfaces being inclined in opposite directions with respect to the movement axis.

18. The coupler as claimed in claim 1, comprising a leaf spring arranged to bias the second locking member into its locking position.

19. The coupler as claimed in claim 1, wherein the first pivoting locking member is shaped to only contact an implement pin seated in the first jaw at or along a single point on the circumference of said implement pin.

20. The coupler as claimed in claim 19, wherein the first pivoting locking member comprises a substantially planar locking surface for contacting the implement pin seated in the first jaw.

21. The coupler as claimed in claim 1, wherein the actuator is a linear actuator.

22. The coupler as claimed in claim 21, wherein the actuator is a hydraulic ram.

* * * * *